US009764418B1

(12) United States Patent
Schroers et al.

(10) Patent No.: US 9,764,418 B1
(45) Date of Patent: Sep. 19, 2017

(54) JOINING OF METALLIC GLASSES IN AIR

(71) Applicant: Yale University, New Haven, CT (US)

(72) Inventors: Jan Schroers, Hamden, CT (US); Wen Chen, New Haven, CT (US); Ze Liu, New Haven, CT (US)

(73) Assignee: Yale University, New Haven, CT (US)

( * ) Notice: Subject to any disclaimer, the term of this patent is extended or adjusted under 35 U.S.C. 154(b) by 479 days.

(21) Appl. No.: 14/290,269

(22) Filed: May 29, 2014

Related U.S. Application Data

(60) Provisional application No. 61/828,721, filed on May 30, 2013.

(51) Int. Cl.

| | |
|---|---|
| ***B23K 20/22*** | (2006.01) |
| ***C22C 1/00*** | (2006.01) |
| ***B23K 20/24*** | (2006.01) |
| ***B23K 20/12*** | (2006.01) |
| ***B23K 31/02*** | (2006.01) |
| ***C22C 45/00*** | (2006.01) |

(52) U.S. Cl.
CPC ..... *B23K 20/22* (2013.01); *B23K 20/12* (2013.01); *B23K 20/1205* (2013.01); *B23K 20/24* (2013.01); *B23K 31/02* (2013.01); *C22C 45/00* (2013.01)

(58) Field of Classification Search
None
See application file for complete search history.

(56) References Cited

U.S. PATENT DOCUMENTS

| | | | | |
|---|---|---|---|---|
| 7,947,134 | B2 | 5/2011 | Lohwongwatana et al. | |
| 2010/0275655 | A1 | 11/2010 | Kawamura et al. | |
| 2011/0027609 | A1* | 2/2011 | Sohn | B23K 26/32 428/615 |
| 2012/0288728 | A1 | 11/2012 | Hofmann et al. | |
| 2014/0283959 | A1* | 9/2014 | Waniuk | C22C 45/00 148/561 |

OTHER PUBLICATIONS

Schroers, J., "Bulk Metallic Glasses," Physics Today (Feb. 2013), pp. 32-37.
Makhanlall, D., et al., "Joining of Ti-based bulk metallic glasses using resistance spot welding technology," Journal of Materials Processing Technology, 212 (2012), pp. 1790-1795.
Wang, G., et al., "Friction joining of Ti40Zr25Ni3Cu12Be20 bulk metallic glass," Journal of Materials Processing Technology, 212 (2012), pp. 1850-1855.

(Continued)

*Primary Examiner* — George Wyszomierski
(74) *Attorney, Agent, or Firm* — Carmody Torrance Sandak & Hennessey LLP

(57) ABSTRACT

A method of joining a bulk metallic glass to a second similar or dissimilar material in an air environment. The method includes the steps of: a) removing an oxide layer on at least a portion of a surface of a first bulk metallic glass during thermoplastic forming of the first bulk metallic glass in a supercooled liquid region, wherein the removing of the oxide layer on the at least the portion of the surface creates a fresh surface that is at least substantially free of oxides and/or contaminants; and b) joining the fresh surface of the first bulk metallic glass to a second material.

16 Claims, 12 Drawing Sheets

(56) References Cited

OTHER PUBLICATIONS

Wang, G., et al., "Laser welding of Ti40Zr25Ni3Cu12Be20 bulk metallic glass," Materials Science and Engineering A, 541 (2012), pp. 33-37.
Johnson, W. L., et al., "Beating Crystallization in Glass-Forming Metals by Millisecond Heating and Processing," Science, vol. 332 (May 13, 2011), pp. 828-833.
Kuo, P., et al., "Bulk-metallic glasses joining in a supercooled-liquid region," Materials Chemistry and Physics, 120 (2010), pp. 532-536.
Schroers, J., "Processing of Bulk Metallic Glass," Advanced Materials, vol. 22 (2010), pp. 1566-1597.
Wang, H., et al., "Microstructure evolution in Nd:YAG laser welded (Zr53Cu30Ni9Al8)Si0.5 bulk metallic glass alloy," Journal of Alloys and Compounds, 495 (2010), pp. 224-228.
Kumar, G., et al., "Nanomoulding with amorphous metals," Nature, vol. 457 (Feb. 12, 2009), pp. 868-872.
Kawahito, Y., et al., "High-power fiber laser welding and its application to metallic glass Zr55Al10Ni5Cu30," Materials Science & Engineering B, 148 (2008), pp. 105-109.
Louzguine-Luzgin, D. V., et al., "Structural investigation of Ni—Nb—Ti—Zr—Co—Cu glassy samples prepared by different welding techniques," Materials Science & Engineering B, 148 (2008), pp. 88-91.
Kim, J. H., et al., "Pulsed Nd:YAG laser welding of Cu54Ni6Zr22Ti18 bulk metallic glass," Materials Science & Engineering A, 449-451 (2007), pp. 872-875.
Li, B., et al., "Laser welding of Zr45Cu48Al7 bulk glassy alloy," Journal of Alloys and Compounds, 413 (2006), pp. 118-121.
Chen, X., "New stress intensity factor solutions of a periodic array of cracks in residual stress field," Mechanics Research Communications, vol. 33 (2006), pp. 425-432.
Swiston, Jr., A., et al., "Thermal and microstructural effects of welding metallic glasses by self-propagating reactions in multilayer foils," Acta Materialia, 53 (2005), pp. 3713-3719.
Kagao, S., "Electron-beam welding of Zr-based bulk metallic glasses," Materials Science & Engineering A, 375-377 (2004), pp. 312-316.
Kawamura, Y., "Liquid phase and supercooled liquid phase welding of bulk metallic glasses," Materials Science & Engineering A, 375-377 (2004), pp. 112-119.
Wong, C., et al., "Friction welding of Zr41Ti14Cu12.5Ni10Be22.5 bulk metallic glass," Scripta Materialia, 49 (2003), pp. 393-397.
Swiston, Jr., A., et al., "Joining bulk metallic glass using reactive multilayer foils," Scripta Materialia, 48 (2003), pp. 1575-1580.
Kawamura, Y., et al., "Spark welding of Zr55Al10Ni5Cu30 bulk metallic glasses," Scripta Materialia, 45 (2001), pp. 127-132.
Lam, K., et al., "Multiple Crack Interaction and its Effect on Stress Intensity Factor," Engineering Fracture Mechanics, vol. 40, No. 3 (1991), pp. 585-592.

* cited by examiner

FIG. 7A
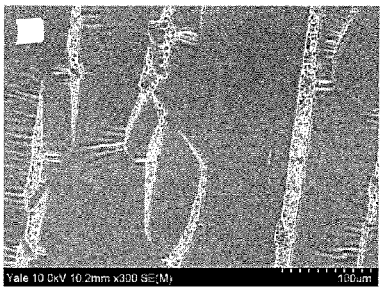
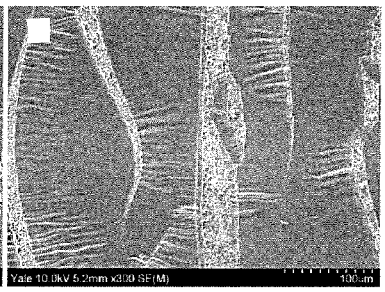
FIG. 7B
FIG. 7C
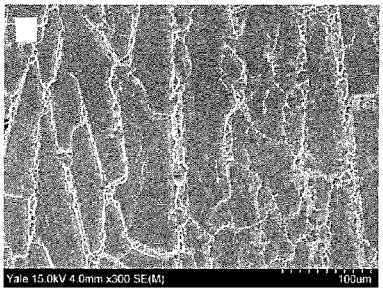
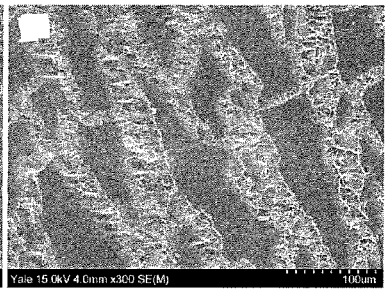
FIG. 7D
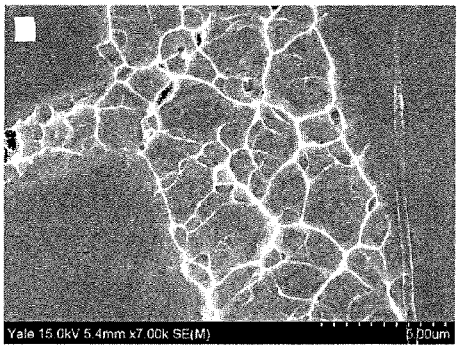
FIG. 7E a. Add metallic glass powder b. Heat and apply strain

JOINING OF METALLIC GLASSES IN AIR

CROSS REFERENCE TO RELATED APPLICATIONS

The present invention claims the benefit of U.S. Provisional Application No. 61/828,721, filed on May 30, 2013, the subject matter of which is herein incorporated by reference in its entirety.

STATEMENT REGARDING FEDERALLY SPONSORED RESEARCH OR DEVELOPMENT

This invention was made with Government support under W911NF-11-1-0380, awarded by the United States Army Research Office. The U.S. Government has certain rights in the invention.

FIELD OF THE INVENTION

The present invention relates generally to methods of joining or bonding bulk metallic glasses to similar or dissimilar materials.

BACKGROUND OF THE INVENTION

Among the attributes of a material that determine its usage is its ability to be joined with the same or other materials. In many cases, it is indispensable to assemble individual parts or components together into an additive product unit with complex structures. Joining of materials can not only offer a chance to scale up the structure, and especially joining of dissimilar materials, but also allows for introducing multifunctional heterogeneity into a structure. In order to achieve a metallic bond between two metal parts, they need to be brought together into atomic contact and the surfaces must be clean. Establishing these requirements is challenging. Most metals oxidize and a rigid oxide layer readily forms, which acts as a diffusion barrier and renders metallic bonding difficult.

Bulk metallic glasses (BMGs), also known as bulk solidifying amorphous alloy compositions, are a class of amorphous metallic alloy materials that are regarded as prospective materials for a vast range of applications because of their superior properties such as high yield strength, large elastic strain limit, and high corrosion resistance. BMG forming compositions may be based on titanium, copper, iron, nickel, palladium, zirconium, gold, cerium, platinum, calcium, magnesium, among others and alone or in combination with each other.

BMGs are regarded as prospective materials for a vast range of applications because of their superior properties such as high yield strength, large elastic strain limit, and high corrosion resistance. A unique property of BMG is that they have a super-cooled liquid region (SCLR), which is a relative measure of the stability of the viscous liquid regime. The SCLR is defined by the temperature difference between the onset of crystallization, $T_x$, and the glass transition temperature, $T_g$, of the particular BMG alloy. These values can be conveniently determined by using standard calorimetric techniques such as DSC (Differential Scanning calorimetry) measurements under a certain heating rate (e.g., at 20° C./min).

Thermoplastic forming (TPF) of an amorphous metal alloy involves heating it into the SCLR and forming it under an applied pressure. The method is similar to the processing of thermoplastics, where the formability, which is inversely proportional to the viscosity, increases with increasing temperature. In contrast to thermoplastics however, the highly viscous amorphous metal alloy is metastable and eventually crystallizes. Because BMGs are amorphous in nature, they can relax upon heating into supercooled liquid region in which the metallic glasses are metastable and are able to flow like plastics, allowing the thermoplastic forming of metallic glasses. Furthermore, it is worthy to note the time window that can be utilized to process metallic glasses is limited at a certain temperature above the glass transition temperature ($T_g$) to guard against crystallization tendency.

Crystallization of the amorphous metal alloy must be avoided for several reasons. First, it degrades the mechanical properties of the amorphous metal alloy. From a processing standpoint, crystallization limits the processing time for hot-forming operation because the flow in crystalline materials is order of magnitude higher than in the liquid amorphous metal alloy. Crystallization kinetics for various amorphous metal alloys allows processing times between minutes and hours in the described viscosity range. This makes the thermoplastic forming method a finely tunable process that can be performed at convenient time scales, enabling the net-shaping of complicated geometries. Since similar processing pressures and temperatures are used in the processing of thermoplastics, techniques used for thermoplastics, including compression molding, extrusion, blow molding, and injection molding have also been suggested for processing amorphous metal alloys as described, for example, in J. Schroers, "Processing of Bulk Metallic Glass," Adv. Mater. 22 (14), 1566-1597 (2010).

To form amorphous metal alloys using a thermoplastic forming process, the amorphous metal alloy must be in its amorphous state, which means that the feedstock must be processed so that the sample is cooled fast to avoid crystallization. During this step, the amorphous metal alloy is typically not formed into its final shape but is rather cast into simple geometries such as cylinders, plates, pellets, and powders. Thereafter, the amorphous metal alloy is hot formed by reheating the material into the supercooled liquid temperature region where the material is formed under isothermal conditions, such that the amorphous state relaxes into a highly viscous metastable liquid that can be formed under applied pressure. Under isothermal conditions, the formability of the amorphous metal alloy increases with increasing processing temperature. Thus, the highest isothermal formability can be achieved at the highest possible processing temperature, so long as crystallization can be avoided.

The ability of an amorphous metal alloy to be thermoplastically formed is described by its formability, a parameter which is directly related to the interplay between the temperature dependent viscosity and time for crystallization as described, for example, in J. Schroers, "On the Formability of Bulk Metallic Glass in its Supercooled Liquid State," Acta Mater. 56 (3), 471-478 (2008); H. Kato, T. Wada, M. Hasegawa, J. Saida, A. Inoue and H. S. Chen, "Fragility and Thermal Stability of Pt- and Pd-based Bulk Metallic Glass Forming Liquids and their Correlation with Deformability," Scripta Mater. 54 (12), 2023-2027 (2006); and E. B. Pitt, G. Kumar and J. Schroers, "Temperature Dependent Formability in Metallic Glasses," J. Appl. Phys. 110 (4) (2011). Crystallization has to be avoided during TPF of an amorphous metal alloy since it degrades the amorphous metal alloy's properties and retards its formability. Therefore, the total time elapsed during TPF of the amorphous metal alloy must be shorter than the time to crystallization.

The fabrication of BMGs requires a cooling rate ($1\sim10^4$ K/s) from the molten liquid alloy to achieve a fully amorphous microstructure. This high required cooling rate has been a significant challenge for joining BMGs to both; similar and dissimilar materials. The high cooling rate has also imposed a size limitation on the BMGs, which has been a key issue for broadening the industrial applications of BMGs. Furthermore, the current fabrication route of BMGs is limited to casting, which can merely produce small-scale and more disappointedly simply geometrical samples. It is therefore of paramount significance to explore convenient and reliable techniques of joining metallic glasses for to extend their structural applications.

Previous studies have attempted thermoplastic joining of BMGs in the supercooled liquid region. However, these studies either required very long diffusion bonding time or required complex experimental conditions, such as a high vacuum level, to avoid surface contamination and oxidation. Furthermore, the results indicated that the joint quality was still unsatisfactory, either because of the oxide film layer between the metallic glasses, which impedes the atomic diffusion, or due to the unavoidable crystallization or phase transformation over the interface after a long period of processing time.

U.S. Pat. No. 7,947,134 to Lohwongwatana et al. the subject matter of which is herein incorporated by reference in its entirety, describes a thermoplastic joining method for joining metals using a BMG as a solder. However, Lohwongwatana is not joining BMGs but is instead using BMG as a thermoplastic joining solder for joining other metals. The bonding of Lohwongwatana relies on surface mechanical interlock by wetting of BMG on metals and no strain applied to the to-be-joined metal pieces. Flux is needed to reduce oxides and impurities on the metal and bulk metallic glass surfaces. In addition, oxygen-inert BMGs and high vacuum ($10^{-6}$ mbar) are required to minimize oxidation during thermoplastic wetting of BMG on the metal surface, which results in low bonding strength (<50 MPa).

U.S. Pat. Pub. No. 2012/0288728 to Hofmann et al. the subject matter of which is herein incorporated by reference in its entirety, describes a joining method for BMGs that uses rapid capacitive charge. However, Hofmann uses an electrical discharge that is applied to the to-be-joined materials to melt the joint area. Because of the use of electrical discharge, the method described by Hofmann can only be used for sequential joining; parallel joining required for an industrial joining of many areas is not achievable by this method. In addition, the process of Hofmann is difficult to control when joining interior parts in a complex BMG structures and there is no predictable joint strength.

U.S. Pat. Pub. No. 2010/0275655 to Kawamura et al. the subject matter of which is herein incorporated by reference in its entirety, describes a joining method for BMGs by electron beam welding. However, Kawamura relies on a high energy electron beam to melt BMGs to bond them. In addition, electron beam welding is a liquid fusion process that is expensive and that utilizes a complicated apparatus and processing parameters. Electron beam welding also has a broad heat affected zone, suffers from easy crystallization of BMGs, and an uncontrollable interface quality. Electron beam welding also is only possible for sequential joining and there is no predictable joint strength.

Laser welding has also been suggested for joining BMGs to other BMGs or dissimilar materials, as described, for example, in B. Li, Z. Y. Li, J. G. Xiong, L. Xing, D. Wang, Y. Li, "Laser welding of $Zr_{45}Cu_{48}Al_7$ bulk glassy alloy," J. Alloy. Compd. 413 (1-2), 118-121 (2006); J. H. Kim, C. Lee, D. M. Lee, J. H. Sun, S. Y. Shin, J. C. Bae, "Pulsed Nd:YAG laser welding of $Cu_{54}Ni_6Zr_{22}Ti_{18}$ bulk metallic glass," Mater Sci Eng A 449-451, 872-875 (2007), and Y. Kawahito, T. Terajima, H. Kimura, T. Kuroda, K. Nakata, S. Katayama, A. Inoue, "High-power fiber laser welding and its application to metallic glass Zr55Al10Ni5Cu30," Mater Sci Eng B 148, 105-109 (2008). However, laser welding is expensive, and requires the optimization of many processing parameters, requires high power input, melting and a broad heat affected zone. In addition, laser welding suffers from potential crystallization and has a tendency to oxidize in the vicinity of the joint. Laser welding is also only suitable for sequential joining and also has no predictable joint strength.

A chemical reactive layer process involves the use of a layer of chemical reactive material and by lighting this inter-medium layer, fuses two BMG layers. Thus, the chemical reactive layer process is a liquid fusion process that relies on a chemical reaction and is expensive. Examples can be found in A. J. Swiston Jr., T. C. Hufnagel, T. P. Weihs, "Joining bulk metallic glass using reactive multilayer foils," Scripta Mater 48, 1575-1580 (2003). and A. J. Swiston Jr., E. Besnoin, A. Duckham, O. M. Knio, T. P. Weihs, T. C. Hufnagel, "Thermal and microstructural effects of welding metallic glasses by self-propagating reactive multilayer foils," Acta Materialia 53, 3713-3719 (2005). Chemical reactive layers have a tendency to melt and suffer from potential local crystallization due to the high amount of heat released during the reaction. In addition, the use of chemical reactive layers also introduces a heterogeneous substance or contaminants into the interface. The chemical reactive layer process is only suitable for sequential joining and also has no predictable joint strength.

Diffusion bonding within the supercooled liquid region is also very impractical. Diffusion bonding involves a long-term diffusion process that is very slow (i.e., >10 minutes), has the potential for crystallization and requires a high vacuum. Diffusion bonding also involves no thermoplastic strain and exhibits no predictable joint strength. An example can be found in P. H. Kuo, S. H. Wang, P. K. Liaw, G. J. Fan, H. T. Tsang, D. C. Qiao, F. Jiang, "Bulk metallic glasses joining in a supercooled-liquid region," Materials Chemistry and Physics, 120, 532-536 (2010).

Various other welding processes for joining BMGs have also been suggested, including friction stir welding, resistance spot welding, and spark welding.

Friction stir welding is a liquid fusion process and suffers from uncontrollable welding processing. In addition, friction stir welding requires an ultra-high mechanical load and has high speed friction and a broad heat affected zone with potential local crystallization. Friction stir welding is available only for sequential joining and exhibits no predictable joint strength. An example of friction welding can be found in C. H. Wong, C. H. Shek, "Friction welding of $Zr_{41}Ti_{14}Cu_{12.5}Ni_{10}Be_{22.5}$ bulk metallic glass," Scripta Materialia 49, 393-397 (2003).

Resistance spot welding is a joining method that involves introducing an electrical resistance layer between two BMGs to generate significant heat to fuse the two BMGs together, such as described in D. Makhanlall, G. Wang, Y. J. Huang, D. F. Liu, J. Shen, "Joining of Ti-based bulk metallic glasses using resistance spot welding technology," Journal of Materials Processing Technology 212, 1790-1795 (2012). Resistance spot welding is also a liquid fusion process and has been found to exhibit significant melting in the fusion zone. In addition, the significant temperature rise induces crystallization and creates a large heat affected zone in the vicinity of the weld. Resistance spot welding also requires a super high welding current and is a difficult process to control. Resistance spot welding is also available only for sequential joining and exhibits no predictable joint strength.

Spark welding is another liquid fusion process that requires ultrahigh current and suffers from melting at the interface of the weld. In addition, spark welding also has a large heat affected zone in the vicinity of the weld. Spark welding suffers from potential embrittlement or crystallization of the weld interface. Spark welding is also available only for sequential joining and exhibits no predictable joint strength. An example can found in Y. Kawamura, Yasuhide Ohno, "Sparking welding of $Zr_{55}Al_{10}Ni_5Cu_{30}$ bulk metallic glasses," Scripta Materialia 45, 127-132 (2001).

Thus, it can be seen that a number of joining methods for BMGs have been investigated, all of which suffer from various deficiencies that make their use less than ideal and it would be desirable to provide an improved method of joining a BMG to a similar or dissimilar material that overcomes the deficiencies of the prior art.

Essentially, in order to obtain good bonding between two BMGs, a considerable amount of physical surface contact between the two BMGs and without contaminations in between is necessary to allow atomic diffusion and metallic bonding in a period of time that is less than the crystallization time of the BMG.

The inventors of the present invention have investigated many different methods for joining BMGs at various temperatures. For example, the inventors tried joining BMGs at room temperature, and failed to bond two BMGs, even with the use of a very high pressure (1 GPa) close to yield point to compress the metallic glasses together and allowed diffusion against each other for several hours, and even conducted in vacuum. The inventors also tried joining BMGs at elevated temperatures slightly above the glass transition temperature, where the viscosity of metallic glasses is still very high, and failed to bond two BMGs together by holding them together (to allow diffusion bonding) without straining. It appeared that the oxide or contaminants on the surface of the BMGs always impeded physical contact between pristine materials from both sides.

Oxidation has being a long-standing issue during the thermoplastic joining of BMGs. As described above, prior studies on joining of BMGs were all carried out under complicated experimental conditions, including high vacuum, to circumvent oxide formation. Previous joining methods also relied mainly on long-range diffusion or melting of the interface. Since diffusion kinetic and crystallization kinetic are similar, crystallization or embrittlement was a significant issue. Melting of the interface engenders pronounced heating, however more often associated with a large heat affected zone. Consequently, crystallization or embrittlement of interface has also been of concern.

The inventors of the present invention were surprised to discover that when thermoplastically forming metallic glasses and straining the surface, that it was possible to achieve pristine material on the surface that facilitated joining. By "pristine" what is meant is that the surface lacks oxides and/or contaminants. In addition, the inventors also determined that the fraction of this pristine surface (which is otherwise extremely difficult and completely impractical to achieve) is directly proportional to the strain the material undergoes on the surface. As such, the process described herein is completely different from diffusion bonding, which requires long range diffusion.

Here, the time scale for joining is set by the time it takes for the pristine BMG to reach the surface and can be estimated to be on the order of seconds or less depending in part on, for example, the thickness of the oxide film, the size of the cracks, the wetting of the BMG on the oxide, and on the forming pressure and temperature for typical processing conditions.

SUMMARY OF THE INVENTION

It is an object of the present invention to provide an improved method of joining a bulk metallic glass to the same bulk metallic glass.

It is another object of the present invention to provide a method of joining a bulk metallic glass to another bulk metallic glass.

It is still another object of the present invention to provide a method of joining a bulk metallic glass to a dissimilar material.

It is still another object of the present invention to provide a method of joining a bulk metallic glass to another bulk metallic glass or dissimilar material that can be performed in series.

It is still another object of the present invention to provide a method of joining a bulk metallic glass to another bulk metallic glass or dissimilar material that can be performed in parallel.

It is yet another object of the present invention to provide a method of joining a bulk metallic glass to another bulk metallic glass or dissimilar material that is capable of forming complex shapes.

To that end, in one embodiment, the present invention relates generally to a method of joining a bulk metallic glass to a second material, the method comprising the steps of:

a) removing an oxide layer on at least a portion of a surface of a first bulk metallic glass during thermoplastic forming of the first bulk metallic glass in a supercooled liquid region resulting in straining of the surface, wherein said removing of the oxide layer on the at least the portion of the surface creates a fresh surface that is at least substantially free of oxides and/or contaminants; and b) joining the fresh surface of the first bulk metallic glass to a second material, wherein the removing and joining steps take place in an air environment.

The method typically further comprises the step of removing an oxide layer on at least a portion of the second material to create a fresh surface on the at least the portion of the second material, prior to joining the fresh surface of the first bulk metallic glass to the second material.

In another embodiment, the present invention also relates generally to a method of joining together two identical bulk metallic glass substrates, the method comprising the steps of:

a) removing an oxide layer on at least a portion of a surface of a first bulk metallic glass substrate during thermoplastic forming of the first bulk metallic glass substrate in a supercooled liquid region, wherein said removing of the oxide layer on the at least the portion of the surface creates a fresh surface on the first bulk metallic glass substrate that is at least substantially free of oxides and/or contaminants;

b) removing an oxide layer on at least a portion of the second bulk metallic glass substrate during thermoplastic forming of the second bulk metallic glass substrate in a supercooled liquid region wherein said removing of the oxide layer on the at least the portion of the surfaces creates a fresh surface on the second bulk metallic glass substrate that is at least substantially free of oxides and/or contaminants; and c) joining the fresh surface of the first bulk metallic glass substrate to the fresh surface of the second bulk metallic glass substrate, wherein the removing and joining steps take place in an air environment.

BRIEF DESCRIPTION OF THE DRAWINGS

FIGS. 7A, 7B, 7C, 7D and 7E depict scanning electron microscope images of shear fractured surfaces of double butt lap joints from different squeezing strains.

DETAILED DESCRIPTION OF THE PREFERRED EMBODIMENTS

Figure 1:
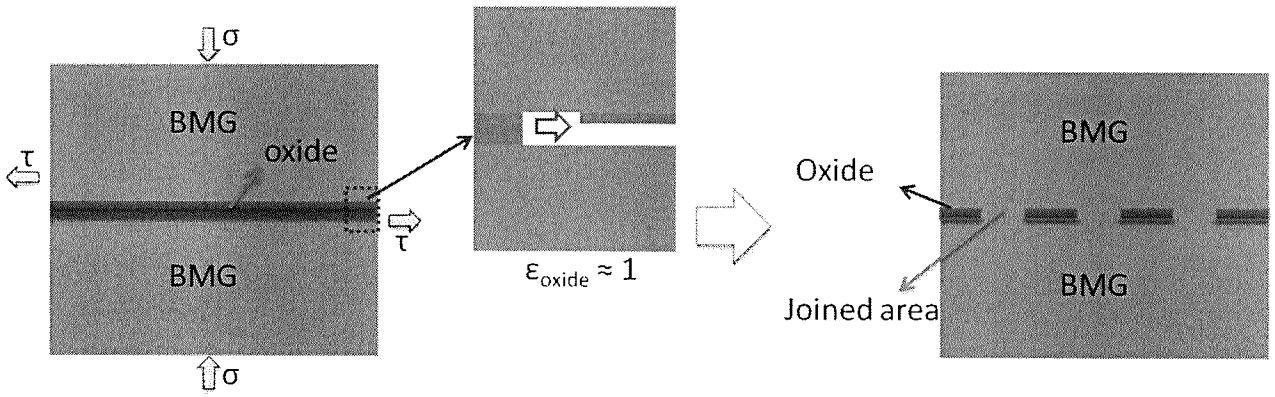
FIG. 1 depicts a schematic of a shearing method of joining bulk metallic glasses in accordance with the present invention.

The invention described herein sets forth improved thermoplastic joining methods for BMGs. As described herein, the inventors of the present invention have discovered that the oxide barrier of the BMG can be readily removed, giving rise to effective metallurgic al bonding between BMGs (or a BMG and a dissimilar material) in the supercooled liquid region.

The present invention allows one to locally or globally join a BMG to a similar or dissimilar material, including other BMGs and other materials. The invention described herein breaks the oxide layer between two BMGs (or a BMG and a dissimilar material) during thermoplastic joining in the supercooled liquid region and promotes immediate contact between the fresh surfaces at a rate faster than the formation of new oxide.

The present invention of joining BMGs is efficient because only heat and a small amount of force are needed to allow joining. In addition, the various processes described herein can all be conducted in air. The simplicity of the invention and easy control of operation allow reliable joining of metallic glasses with excellent and predictable joint strength without the need for complicated apparatuses.

The invention described herein sets forth various methods and processing conditions for joining identical metallic glasses, especially reactive metallic glass alloy systems, in an air atmosphere. It is also feasible to join dissimilar metallic glasses, in which the metallic glasses have an overlapping supercooled liquid region, or to join metallic glass with other types of materials.

To that end, in one embodiment, the present invention relates generally to a method of joining a bulk metallic glass to a second material, the method comprising the steps of:

a) removing an oxide layer on at least a portion of a surface of a first bulk metallic glass during thermoplastic forming of the first bulk metallic glass in a supercooled liquid region, wherein said removing of the oxide layer on the at least the portion of the surface creates a fresh surface that is at least substantially free of oxides and/or contaminants; and b) joining the fresh surface of the first bulk metallic glass to a second material, wherein the removing and joining steps take place in an air environment.

Prior to joining the fresh surface of the first bulk metallic glass to the second material the method optionally, but preferably, further comprises the step of removing an oxide layer on at least a portion of the second material to create a fresh surface on the at least the portion of the second material.

In another embodiment, the present invention also relates generally to a method of joining together two identical bulk metallic glass substrates, the method comprising the steps of:

a) removing an oxide layer on at least a portion of a surface of a first bulk metallic glass substrate during thermoplastic forming of the first bulk metallic glass substrate in a supercooled liquid region, wherein said removing of the oxide layer on the at least the portion of the surface creates a fresh surface on the first bulk metallic glass substrate that is at least substantially free of oxides and/or contaminants;

b) removing an oxide layer on at least a portion of the second bulk metallic glass substrate during thermoplastic forming of the second bulk metallic glass substrate in a supercooled liquid region wherein said removing of the oxide layer on the at least the portion of the surfaces creates a fresh surface on the second bulk metallic glass substrate that is at least substantially free of oxides and/or contaminants; and c) joining the fresh surface of the first bulk metallic glass substrate to the fresh surface of the second bulk metallic glass substrate, wherein the removing and joining steps take place in an air environment.

Some important characteristics and advantages of the proposed joining method over other methods, include, but are not limited to:

1) Most traditional methods for joining BMGs are either not applicable or are unsatisfactory;

2) The methods described herein are practical and easy to control (i.e., low pressure and strain within the supercooled liquid region);

3) The methods described herein are economical, requiring no complicated setup or use of high vacuum;

4) The methods described herein are reliable and results in a predictable joint strength;

5) The methods described herein allow for joining oxidation-sensitive/active BMGs or superplastic materials in air;

6) The methods described herein require a very short joining time scale (order of seconds) to maintain the initial microstructure, which is especially useful for joining BMGs having low thermal stability; and 7) The methods described herein are a low temperature processes (i.e, $T<0.5T_m$).

The joining processes described herein are highly practical and can be achieved within seconds. The processes are carried out in air under low mechanical loads, and can yield a very high quality joining interface.

The overall principle of the joining methods described herein is that the oxide layer or contaminations between the two to-be-joined BMGs is broken to create pristine fresh surfaces, after which atomic intimate contact of the freshened surfaces is immediately undertaken. It is also critical that the creation of the pristine surface is achieved faster than the formation of new oxide or other contaminations.

The inventors of the present invention have demonstrated that even for highly reactive Zr-based BMGs, this can be readily achieved when processed in air. One reason for this is due to the ability of the BMG during thermoplastic forming to replicate surfaces with highest, close to atomic precision. Therefore, when the oxide layer breaks the "crack" where pristine material flows in, it is closed from the air processing environment. The atomic inter-replication of the two surfaces and the atomic adhesion as well as the atomic inter-diffusion can be readily accomplished in a very short time, and contribute to the strong metallurgical bond over the interface.

The following three examples set forth below explain various methods of removing the oxide barrier during thermoplastic bonding of BMGs in air, and therefore achieving metallic bonding interface. It is noted that upon heating to the supercooled liquid region, most BMGs with active elements oxidize, however with varying thickness of the oxidized layer.

To demonstrate the invention, a reactive Zr-based metallic glass, $Zr_{35}Ti_{30}Cu_{7.5}Be_{27.5}$ was chosen. The glass transition temperature, $T_g$, and the crystallization onset temperature, $T_x$, for this metallic glass are approximately 310° C. and 465° C., respectively at a heating rate of 20 K/min.

Figure 2:
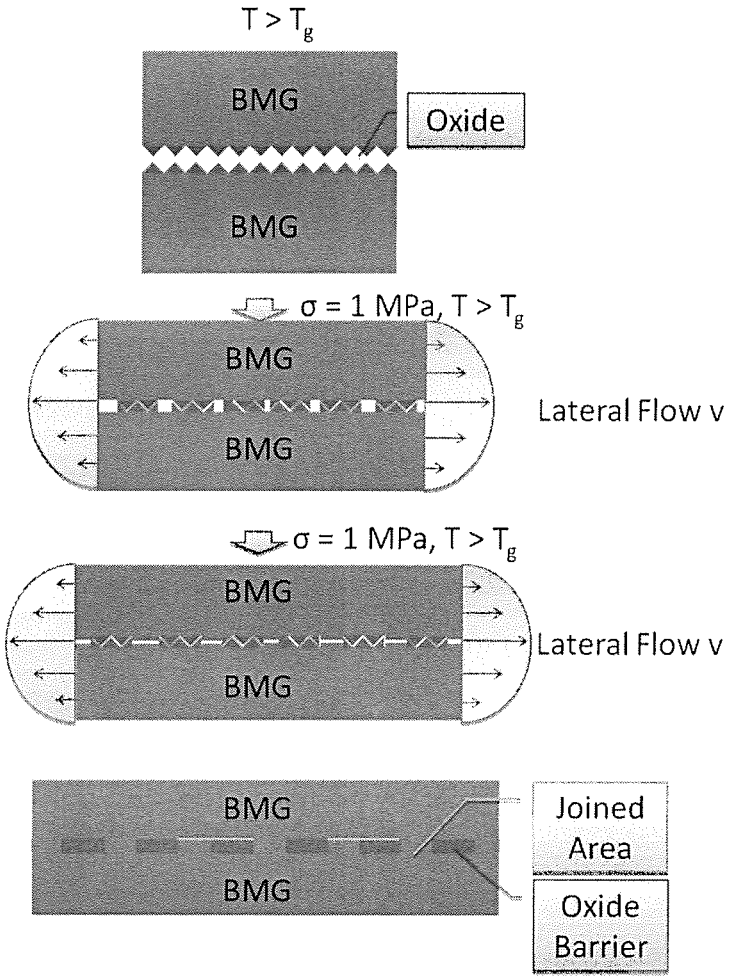
FIG. 2 depicts a schematic of a squeezing method of joining bulk metallic glasses in accordance with the present invention.
Figure 3:
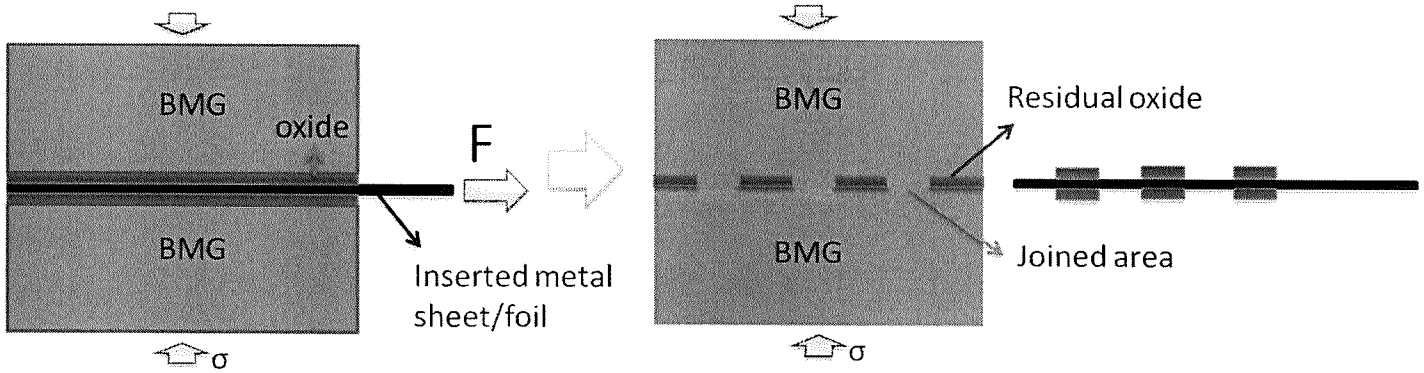
FIG. 3 depicts a schematic of an oxide pulling method of joining bulk metallic glasses in accordance with the present invention.

As shown in FIGS. 1, 2 and 3, under the overall principle of the invention (i.e., creating a large contact area through thermoplastic compression molding, straining of the BMG on the surface break oxide layer, and allowing pristine BMG to get to the surface within seconds or less which forms a metallic bond), the inventors of the present invention have employed three different methods of removing the oxide from the metallic glass interface, which are referred to herein as "shearing," "squeezing," and "oxide pulling" respectively. These methods are all based on a thermoplastic bonding process that only requires a very short time span, which is substantially shorter than the crystallization time window, so that crystallization can easily be circumvented during joining of the metallic glasses.

1) Shearing: Generally, any kind of deformation that results in shear strain on the surface can be used to remove the oxide layer by shearing.

In the shearing method, the steps of removing the oxide layer on the at least the portion of the surface of the first bulk metallic glass and the at least the portion of the second material and joining the fresh surfaces of the first bulk metallic glass and the fresh surface of the second material comprise:

heating the first bulk metallic glass and the second material to within the supercooled liquid region of the first bulk metallic glass; and applying a normal stress to hold the first metallic glass in contact with the second material, and at least substantially simultaneously applying a shearing force between the first bulk metallic glass and the second material to create a shear stress over the interface between the first bulk metallic glass and the second material.

FIG. 1 depicts a schematic illustration of one shearing joining method that may be used to remove the oxide layer in order to enable close contact of the freshened surface.

In this process, the BMGs are first heated to within the supercooled liquid region of the particular BMG (i.e, a temperature of 420° C. for the reactive Zr-based bulk metallic glass used herein). A normal stress $\sigma$ of between about 0.1 to about 10 MPa (depending on the strain rate), more preferably about 1 to about 10 MPa is applied to hold the two metallic glasses together. At least substantially simultaneously a lateral shearing force is applied between the two metallic glasses in order to create a respective shear stress $\tau$ over the metallic glass interface.

Shearing can also be accomplished by applying torque or spinning or any other method that results in shear strain on the surface.

Finally, the shear rate should also be controlled to be very slow (i.e., quasi-static) in order to avoid relative sliding of the two oxide layers against each other. Upon shearing, a true shear strain $\epsilon \approx 1$ takes place in some local oxide areas as depicted in FIG. 1. This significant shear strain tends to drive the fracture of the brittle oxide film, so that the two fresh metallic glass surfaces will contact subsequently and join each other with the assistance of the pre-applied normal pressure $\sigma$. Eventually, the interface exhibits a microscopic characteristic of alternative distribution of the oxide and the joined areas.

2) Squeezing

In the squeezing method, the steps of removing the oxide layer on the at least the portion of the surface of the first bulk metallic glass and the at least the portion of the second material and joining the fresh surfaces of the first bulk metallic glass and the fresh surface of the second material comprise:

heating the first bulk metallic glass and the second material to within the supercooled liquid region of the first bulk metallic glass; and applying a normal stress and a uniaxial strain to the first bulk metallic glass and the second material under a specified strain rate, causing lateral flow or lateral protrusion of at least the portion of the surface of the first bulk metallic glass and the at least the portion of the surface of the second material, wherein the oxide layer on the at least the portion of the surface of the first bulk metallic glass and/or the oxide layer on the at least the portion of the surface of the second material becomes discontinuous, and fresh metallic glass refills the discontinuous oxide areas;

wherein the fresh surface of the first bulk metallic glass and the fresh surface of the second material are in physical contact and metallurgical bonding is achieved.

FIG. 2 depicts a schematic of a squeezing method of joining of BMGs.

After heating the two BMGs into the supercooled liquid (i.e., a temperature of 420° C. for the reactive Zr-based metallic glass used herein), a normal stress $\sigma=1$ MPa and a uniaxial strain $\epsilon$ is applied to the two pieces of BMGs under a strain rate of $10^{-2}$ $s^{-1}$, which leads the subsequent lateral flow or lateral protrusion. With this lateral flow, the oxide layer can be torn apart by the lateral strain and thus become discontinuous, offering an opportunity for the pristine metallic glass to refill the cracked oxide areas and closely contact.

The intimate physical contact and atomic inter-replication enable one to achieve metallurgical bonding over the interface. It is expected that the joined area fraction should be directly proportional to the associated joining strain $\epsilon$ (or squeezing strain) while the cracked oxide area maintains approximately constant, depending on the initial surface area before joining.

3) Oxide Pulling

In the oxide pulling method, the steps of removing the oxide layer on the at least the portion of the surface of the first bulk metallic glass and the at least the portion of the second material and joining the fresh surfaces of the first bulk metallic glass and the fresh surface of the second material comprise:

heating the first bulk metallic glass and the second material to within the supercooled liquid region of the first bulk metallic glass;

pressing the at least the portion of the first bulk metallic glass and the at least the portion of the second material against each other with an intermediate layer of metal inserted therebetween; and pulling the intermediate layer of metal to create wear between the at least the portion of the first bulk metallic glass and the at least the portion of the second material, thereby breaking off the oxide layer on the at least the portion of the surface of the first bulk metallic glass and the at least the portion of the second material.

FIG. 3 depicts a schematic of an oxide pulling method of joining BMGs.

As shown in FIG. 3, after heating the BMG to above Tg, the two BMGs are pressed against each other with an intermediate layer of metal (e.g., stainless steel) sheet or foil inserted between. In the alternative, a metal cable or wire may be used. It is essentially that the pulling of the metal sheet/foil (or wire/cable) creates considerable wear between the two BMG surfaces and the metal sheet/foil, thereby breaking off the oxide on the metallic glasses. The amount of the residual oxide remaining on the joined interface is determined by the wear process as mentioned above, which depends primarily on the pulling speed (comparable to the oxidation rate), the surface roughness of the metallic glasses and the metal sheet/foil, as well as the pulling force F.

It is further noted that while there may also be a reactive mechanism in the foil, apart from shear forces, that destroys the oxide to create joinable surfaces, the present invention is directed to the use of shear forces to create the wear between the two BMG surfaces (or the BMG surface and the surface of another material).

Among these three examples, the squeezing method is the most effective one from a practical viewpoint. The shearing method requires a shear velocity that can promote relative shear while avoiding relative sliding between two BMG surfaces, which is difficult to achieve practically. The oxide pulling method involves a high pulling speed that exceeds the oxidization rate.

Figure 4:
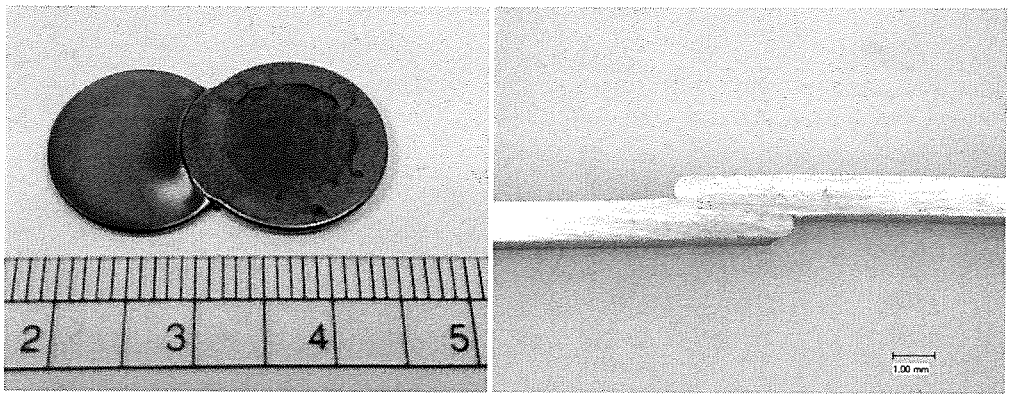
FIG. 4 depicts examples of a double butt lap metallic glass joint produced in accordance with the present invention.

As an example to quantitatively evaluate the joint quality achievable by the methods described herein, double butt lap joints were cut from squeezing-joined BMG pairs, a typical sample of which is shown in FIG. 4. In addition, uni-axial shear tests were performed to measure the shear strength of the joints, and FIG. 5 shows the shear strength associated with different joining strains using the squeezing-joining approach.

Figure 5:
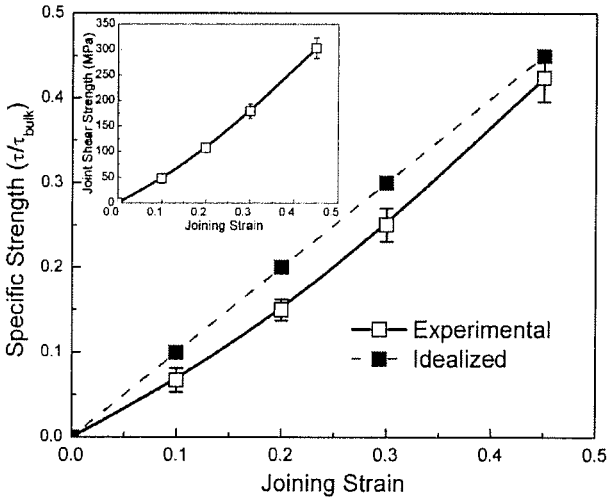
FIG. 5 depicts a plot of joint shear strength versus joining strain.

As can be seen from FIG. 5, shear strength of the joint between the first bulk metallic glass and the second material is roughly proportional to the squeezing strain, provided that the initial metallic glass surface roughnesses from the different squeezing strains are quite close to each other (i.e., polished to the same quality) in order to eliminate the influence from the surface roughness difference induced atomic diffusion path difference.

Figure 6:
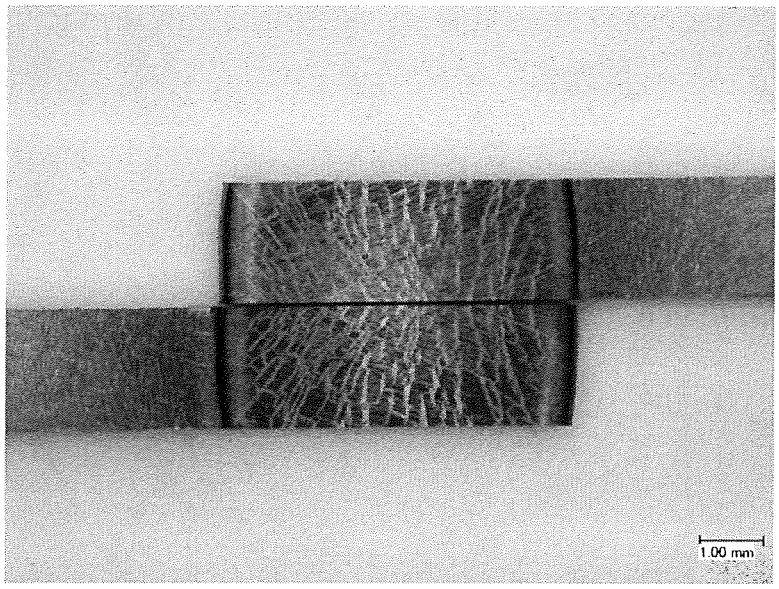
FIG. 6 depicts sheared surfaces of a double butt lap joint.

FIG. 6 represents typical sheared pieces from the tested double butt lap joint. The enlarged scanning electron microscopy (SEM) views of the sheared surfaces after shear tests are shown in FIGS. 7A, 7B, 7C, 7D and 7E.

Obviously, the high shear strength of joints arises from the good metallurgical bonding that is accomplished during the thermoplastic joining of the two metallic glasses, as reflected in the representative vein pattern fingerprints on the sheared surfaces after shear fracture of the BMGs as shown in FIGS. 7A, 7B, 7C, 7D and 7E. The smooth areas in the SEM images correspond to the residual oxide on the BMG surface. After a statistical analysis was performed on all the SEM images, it was determined that the fraction of the joined area is strongly linear dependent on (i.e., very close to) the strain input during squeezing, which reasonably elucidates the close-to-linear relationship between the shear strength and the joining strain. Within the interface, the intermittently distributed oxides behave like the role of "microcracks".

The shear strength of the joined vein-like patterns may be defined as $\tau_{bulk}$, the shear strength of the bulk material, while the shear strength of the intermittent smooth oxide areas (microcracks) may be defined as $\tau_{crack}$. As such, the interface can be regarded as a dual phase composite, the yield strength of which can be roughly estimated by superimposition: $\tau=\tau_{bulk}f_{bulk}+\tau_{crack}f_{crack}$, where $\tau_{bulk}$=1.43 GPa for $Zr_{35}Ti_{30}Cu_{7.5}Be_{27.5}$ metallic glass, and $\tau_{crack}$=0 GPa, $f_{bulk}$ and $f_{crack}$ denotes the area fraction of the total joined area and the oxide area, respectively.

Based thereon, the above yield strength formula can simply reduce to $\tau=\tau_{bulk}f_{bulk}$. Considering the joined area equals the applied joining squeezing strain $\epsilon$, i.e., $f_{bulk}=\epsilon$, the close to linear relationship between the yield strength of the joined interface and the joining strain can be understood according to the analysis above. From a practical point of view, this linear behavior is helpful and can be utilized to precisely predict the yield strength of a joint under a certain joining strain, which is a significant advantage over other conventional joining processes.

Figure 8:
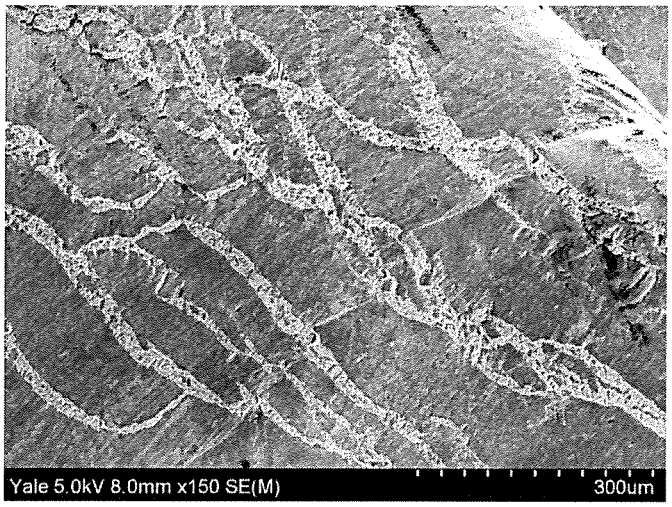
FIG. 8 depicts a scanning electron microscope image of shear fractured surfaces of double butt lap joints from an oxide pulling method.

As for the reason why the shear strength slightly deviates from the linear trend with the increasing joining strain, the inventors believe that the intermittently distributed oxides behave not only as one "void" phase of the dual phases in dictating the yield strength, but ironically they even play a role of "microcracks" in degrading the overall shear strength of the interface. Given this effect included, the shear strength $\tau$ of the joining interface can be derived by:

$$\tau = \tau_{bulk}\frac{f_{bulk}}{Y\sqrt{\pi a}} \tag{1}$$

where Y is a geometry factor of the oxide "microcracks" and is a finite value, a is the average length of these "microcracks" and scales up with decreasing joining strain as shown in FIG. 7. Here, the crack length a plays a more dominant role than the geometry factor in determining the final shear strength, which explains the $$\tau \propto \frac{1}{\sqrt{a}}$$

trend in the strength plot. In this context, it is worthwhile to mention that the intermittent distribution of the residual oxide and the joined area is consistent with our schematic illustration of the thermoplastic diffusion bonding mechanism, for the oxide pulling method as well as depicted in FIG. 8.

Some specific examples of the use of the joining methods described herein for joining metallic glasses include:

1) Joining a metallic glass to another metallic glass of the same type.

2) Joining one metallic glass to another dissimilar bulk metallic glass having a similar glass transition temperature and formability, such as two different bulk metallic glasses from the same family. Examples include, but are not limited to:

a) Joining $Zr_{35}Ti_{30}Cu_{7.5}Be_{27.5}$ ($T_g$=583 K, $T_x$=738 K) with $Zr_{44}Ti_{11}Cu_{10}Ni_{10}Be_{25}$ ($T_g$=623 K, $T_x$=744 K); and b) Joining $Pd_{45}Cu_{25}Ni_{10}P_{20}$ ($T_g$=595 K, $T_x$=675 K) with $Pd_{40}Cu_{25}Ni_{15}P_{20}$ ($T_g$=596 K, $T_x$=668 K), 3) Joining two bulk metallic glasses from different families. Examples include, but are not limited to:

a) Joining a nickel-based metallic glass such as $Ni_{42}Ti_{20}Zr_{22.5}Al_8Cu_5Si_{2.5}$ ($T_g$=767 K, $T_x$=833 K) with an iron-based metallic glass such as $Fe_{75}Mo_4P_{10}C_4B_4Si_3$ ($T_g$=752 K, $T_x$=799 K); and b) Joining a Zr-based metallic glass such as $Zr_{44}Ti_{11}Cu_{10}Ni_{10}Be_{25}$ ($T_g$=623 K, $T_x$=744 K) with a Pd-based metallic glass such as $Pd_{40}Cu_{25}Ni_{15}P_{20}$ ($T_g$=596 K, $T_x$=668 K).

4) Joining bulk metallic glasses to other materials whose surface oxide is capable of undergoing strain at the thermoplastic joining temperature region of the metallic glasses. An example of this type of material is a superplastic Mg alloy. Other materials include, but are not limited to, superplastic Al, Ti alloys. As a general rule, superplastic alloys soften at a temperature of $T>0.6\ T_m$ (melting temperature). Thus, if $T_g$ of the metallic glass approaches $0.6\ T_m$ for the superplastic metal alloy, the two materials can be potentially joined through thermoplastic joining.

The inventors of the present invention have found that very good results can be obtained when one bulk metallic glass is joined to another piece of the same bulk metallic glass.

Pristine material contact is a crucial requirement for metallic bond formation. Thus, preservation of the pristine surface can be used to join a bulk metallic glass to another bulk metallic glass or to a different material. For example, a thin copper film can be deposited onto two to-be-joined parts before joining and breaking the thin films of the two parts during thermoplastic joining offers an opportunity for the two parts to join.

The invention described herein allows for the creation of complex shapes through joining of materials. Surfaces can be joined globally or selectively by patterning the surface (i.e., the joint area) with a material (such as a stainless steel sheet) that prevents joining. The invention described herein also provides for one-step simultaneous thermoplastic forming and joining, where some of the bulk metallic glasses can be thermoplastically formed into desired shapes while some other local areas are joined together during thermoplastic forming. The present invention also allows for the fabrication of complex structures and three dimensional structures out of bulk metallic glasses by a combination of thermoplastic deformation and joining. Using the method described herein, some areas of various BMG parts can be joined whereas meanwhile other areas can be thermoplastically deformed to produce three dimensional complex structures.

The joining strength of the BMG is highly predictable, and scales with the controllable fresh surface contact. This is ideal for some joints with specifically intended mechanical parameters.

The present invention also allows for the joining of a large metallic glass sheet or other components where a large metallic glass shape or geometry is required. In this situation, it is extremely challenging to use conventional methods of joining materials such as friction welding, electron beam welding, pulse current welding and so forth.

Another benefit of the present invention is that only a very short time (i.e., seconds) is needed to achieve a metallic bond. This short processing period can easily bypass crystallization, which allows for thermoplastic joining of metallic glass alloy systems having a very narrow thermoplastic processing window or low thermal stability in the supercooled liquid region.

The present invention can also be used to join any particles or pellets by surface straining to create pristine material contact, which enables one to build a larger structure from small particles or pellets. Thus, the present invention allows for metallic glass powder joining in air and with controllable and predictable joint strength and allows for the formation of complex BMG parts from metallic glass powders in air.

In order to achieve fresh surfaces from metallic glass powders, a significant shear force component is required to break the oxide on the powder surfaces. For instance, to achieve a joints strength of 10% of the bulk strength, an average shear component of >10% out of the overall deformation is required.

Figure 9:
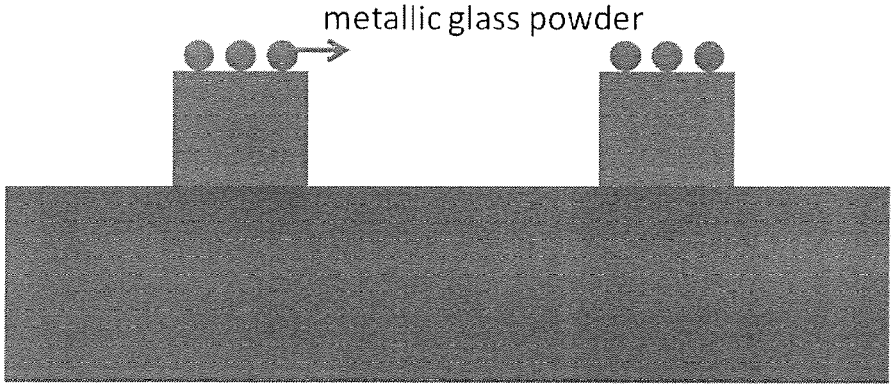
FIG. 9 depicts a schematic using metallic glass powder joining to achieve additive manufacturing.
Figure 9:
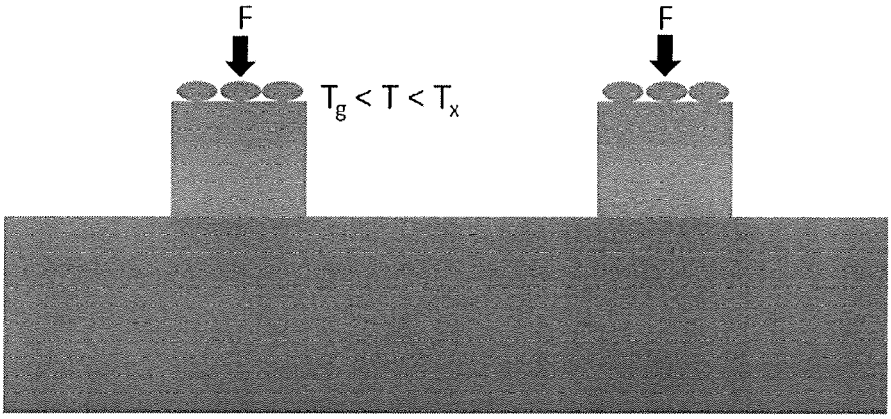

An example of the precise additive manufacturing of metallic glass structures by metallic glass powder joining is shown in FIG. 9. As depicted in FIG. 9, using metallic glass powder joining, additive manufacturing can be achieved by applying a thermoplastic strain on the powders and locally heating the metallic glass powder up to the supercooled liquid state. Local heat can be generated, for example through an electrical current. Other means of local heat generation include combustion, friction, etc.

The present invention can also be used for the parallel joining of many spots from various BMG pieces by thermoplastically straining those spots at the same time. This is contrasted with the prior art which was only able to achieve sequential joining in which only one joint may be achieved at a time.

Figure 10:
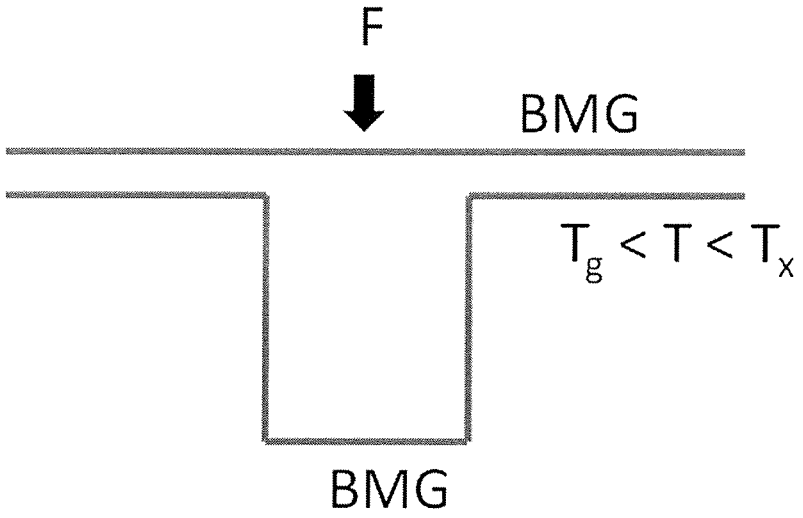
FIG. 10 depicts packaging using bulk metallic glasses.

The present invention may also be used for packaging applications, such as waterproof watches, electronic devices and MEMS packaging in vacuum as shown in FIG. 10 and for micro-assembly/joining applications.

Figure 11:
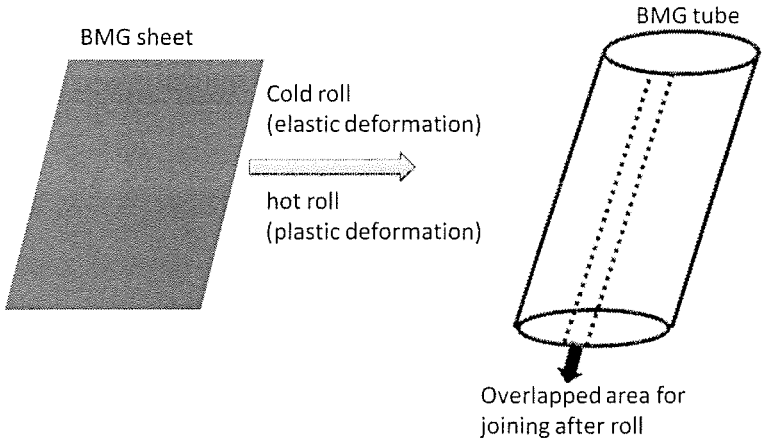
FIG. 11 depicts bulk metallic glass tube fabrication through rolling and joining of a bulk metallic glass sheet.

Another application of the present invention is in metallic glass tube fabrication, as depicted in FIG. 11. Using the methods described herein, one can roll a bulk metallic glass sheet by cold roll (elastic deformation) or hot roll (plastic deformation) to achieve a tube shape with an overlapped area for thermoplastic joining to form a bulk metallic glass tube.

Figure 12:
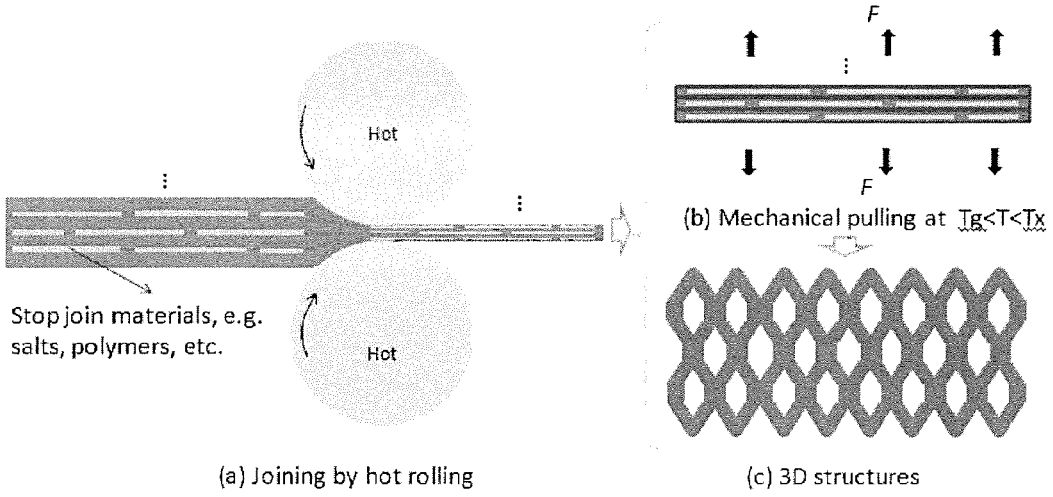
FIG. 12 depicts the fabrication of three dimensional bulk metallic glass structures by spaced joining and following mechanical pulling at supercooled liquid regions.
Figure 13:
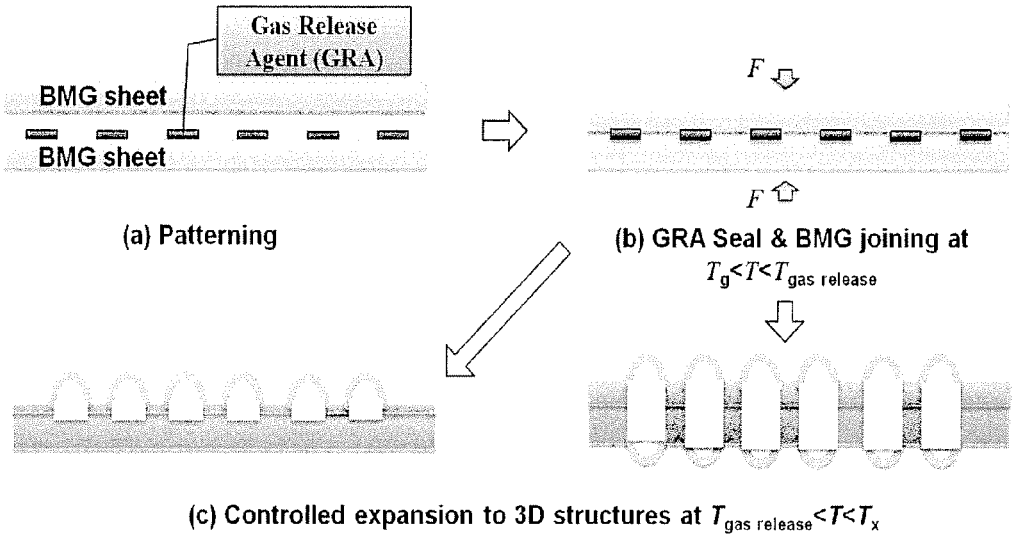
FIG. 13 depicts the fabrication of three dimensional bulk metallic glass structures joining with a gas release agent.

Finally, the methods described herein may also be used to fabricate complex structures and three dimensional structures out of metallic glasses by a combination of thermoplastic deformation and joining. By using the method described herein, some areas of various bulk metallic glass parts can be joined, whereas others do not join intentionally and are thus thermoplastically deformed to produce three dimensional complex structures as depicted in FIGS. 12 and 13. FIG. 12 depicts a fabrication method of three dimensional bulk metallic glass structures by spaced joining and following mechanical pulling at supercooled liquid regions.

FIG. 13 depicts a fabrication method of three dimensional bulk metallic glass structures joining using a gas release agent (e.g., $MnCO_3$, $NiCO_3$, $ZrH_2$, $TiH_2$, etc.) sealed and following expansion at the supercooled liquid regions.

It should also be understood that the following claims are intended to cover all of the generic and specific features of the invention described herein and all statements of the scope of the invention that as a matter of language might fall there between.

What is claimed is:

1. A method of joining a bulk metallic glass to a second material, the method comprising the steps of:

a) removing an oxide layer on at least a portion of a surface of a first bulk metallic glass during thermoplastic forming of the first bulk metallic glass in a supercooled liquid region, wherein said removing of the oxide layer on the at least the portion of the surface creates a fresh surface that is at least substantially free of oxides and/or contaminants; and b) joining the fresh surface of the first bulk metallic glass to a second material, wherein the removing and joining steps take place in an air environment.

2. The method according to claim 1, further comprising the step of removing an oxide layer on at least a portion of the second material to create a fresh surface on the at least the portion of the second material, prior to joining the fresh surface of the first bulk metallic glass to the second material.

3. The method according to claim 2, wherein the steps of removing the oxide layer on the at least the portion of the surface of the first bulk metallic glass and the at least the portion of the second material and joining the fresh surfaces of the first bulk metallic glass and the fresh surface of the second material comprise:

heating the first bulk metallic glass and the second material to within the supercooled liquid region of the first bulk metallic glass; and applying a normal stress to hold the first metallic glass in contact with the second material, and at least substantially simultaneously applying a shearing force between the first bulk metallic glass and the second material to create a shear stress over the interface between the first bulk metallic glass and the second material.

4. The method according to claim 3, wherein the shear force is accomplished by applying a lateral shearing force, applying torque or by spinning to achieve shear strain on the at least the portion of the first bulk metallic glass and the second material.

5. The method according to claim 3, wherein the normal stress is in the range of about 1 to about 10 MPa.

6. The method according to claim 5, wherein the normal stress is in the range of about 4 to about 7 MPa.

7. The method according to claim 2, wherein the steps of removing the oxide layer on the at least the portion of the surface of the first bulk metallic glass and the at least the portion of the second material and joining the fresh surfaces of the first bulk metallic glass and the fresh surface of the second material comprise:

heating the first bulk metallic glass and the second material to within the supercooled liquid region of the first bulk metallic glass; and applying a normal stress and a uniaxial strain to the first bulk metallic glass and the second material under a specified strain rate, causing lateral flow or lateral protrusion of at least the portion of the surface of the first bulk metallic glass and the at least the portion of the surface of the second material, wherein the oxide layer on the at least the portion of the surface of the first bulk metallic glass and/or the oxide layer on the at least the portion of the surface of the second material becomes discontinuous, and fresh metallic glass refills the discontinuous oxide areas;

wherein the fresh surface of the first bulk metallic glass and the fresh surface of the second material are in physical contact and metallurgical bonding is achieved.

8. The method according to claim 7, wherein the normal stress is in the range of about 0.1 to about 20 MPa.

9. The method according to claim 8, wherein the normal stress is in the range of about 0.1 to about 15 MPa.

10. The method according to claim 7, wherein the strain rate is in the range of about $10^{-1}$ $s^{-1}$ to about $10^{-3}$.

11. The method according to claim 10, wherein the strain rate is about $10^{-2}$ $s^{-1}$.

12. The method according to claim 7, wherein the joined area fraction is directly proportional to an associated joining strain.

13. The method according to claim 2, wherein the steps of removing the oxide layer on the at least the portion of the surface of the first bulk metallic glass and the at least the portion of the second material and joining the fresh surfaces of the first bulk metallic glass and the fresh surface of the second material comprise:

heating the first bulk metallic glass and the second material to within the supercooled liquid region of the first bulk metallic glass;

pressing the at least the portion of the first bulk metallic glass and the at least the portion of the second material against each other with an intermediate layer of metal inserted therebetween; and pulling the intermediate layer of metal to create wear between the at least the portion of the first bulk metallic glass and the at least the portion of the second material, thereby breaking off the oxide layer on the at least the portion of the surface of the first bulk metallic glass and the at least the portion of the second material.

14. The method according to claim 1, wherein the second material comprises a bulk metallic glass that has a different glass transition temperature and formability than the first bulk metallic glass.

15. The method according to claim 1, wherein the second material is a material whose surface oxide is capable of undergoing strain at a thermoplastic temperature joining region of the first bulk metallic glass.

16. A method of joining together two identical bulk metallic glass substrates, the method comprising the steps of:

a) removing an oxide layer on at least a portion of a surface of a first bulk metallic glass substrate during thermoplastic forming of the first bulk metallic glass substrate in a supercooled liquid region, wherein said removing of the oxide layer on the at least the portion of the surface creates a fresh surface on the first bulk metallic glass substrate that is at least substantially free of oxides and/or contaminants;

b) removing an oxide layer on at least a portion of the second bulk metallic glass substrate during thermoplastic forming of the second bulk metallic glass substrate in a supercooled liquid region wherein said removing of the oxide layer on the at least the portion of the surfaces creates a fresh surface on the second bulk metallic glass substrate that is at least substantially free of oxides and/or contaminants; and c) joining the fresh surface of the first bulk metallic glass substrate to the fresh surface of the second bulk metallic glass substrate, wherein the removing and joining steps take place in an air environment.

* * * * *